US008863453B2

(12) United States Patent
D'Agostini

(10) Patent No.: US 8,863,453 B2
(45) Date of Patent: Oct. 21, 2014

(54) DOOR FRAME ANCHOR

(71) Applicant: Luigi D'Agostini, Scarborough (CA)

(72) Inventor: Luigi D'Agostini, Scarborough (CA)

( * ) Notice: Subject to any disclaimer, the term of this patent is extended or adjusted under 35 U.S.C. 154(b) by 0 days.

(21) Appl. No.: 13/690,665

(22) Filed: Nov. 30, 2012

(65) Prior Publication Data

US 2013/0199116 A1 Aug. 8, 2013

Related U.S. Application Data

(60) Provisional application No. 61/611,752, filed on Mar. 16, 2012, provisional application No. 61/636,952, filed on Apr. 23, 2012.

(30) Foreign Application Priority Data

Feb. 6, 2012 (CA) ..... 2767152

(51) Int. Cl.

| | |
|---|---|
| ***E06B 1/04*** | (2006.01) |
| ***E04B 1/38*** | (2006.01) |
| ***E06B 1/52*** | (2006.01) |
| ***E06B 1/60*** | (2006.01) |
| ***E06B 1/22*** | (2006.01) |

(52) U.S. Cl.

CPC ... *E06B 1/22* (2013.01); *E06B 1/52* (2013.01); *E06B 1/6092* (2013.01); *E04B 1/38* (2013.01)

USPC ..... 52/213; 52/210; 52/713; 52/715

(58) Field of Classification Search

CPC ..... E04B 2/767; E04B 2001/2415; E04B 2001/405; E04B 1/003; E04B 1/60; E04B 1/6015; E04B 1/6023; E04B 1/6092

USPC ..... 52/204.1, 210, 211, 213, 217, 655.1, 52/656.2, 656.4, 656.9, 712, 713, 715, 52/745.15; 49/504, 505

See application file for complete search history.

(56) References Cited

U.S. PATENT DOCUMENTS

| | | | | |
|---|---|---|---|---|
| 2,574,350 | A * | 11/1951 | Peelle | 52/213 |
| 2,598,139 | A * | 5/1952 | Shea | 52/211 |
| 2,846,868 | A * | 8/1958 | Werner Wedberg | 52/211 |
| 2,939,185 | A * | 6/1960 | Ader et al. | 49/380 |
| 3,103,263 | A * | 9/1963 | Leeser | 52/213 |
| 3,385,004 | A * | 5/1968 | Oehler et al. | 49/504 |
| 3,636,672 | A * | 1/1972 | Fink | 52/214 |
| 4,539,784 | A * | 9/1985 | Allen | 52/217 |
| 5,771,644 | A * | 6/1998 | Kidd | 52/213 |
| 5,810,303 | A * | 9/1998 | Bourassa et al. | 248/205.1 |
| 6,405,506 | B2 * | 6/2002 | Ruff | 52/656.4 |

(Continued)

FOREIGN PATENT DOCUMENTS

| | | |
|---|---|---|
| CA | 736144 | 6/1966 |
| CA | 1152366 | 8/1983 |

*Primary Examiner* — Ryan Kwiecinski

(74) *Attorney, Agent, or Firm* — Bereskin & Parr LLp S.E.N.C.R.L., s.r.l

(57) ABSTRACT

An anchor for securing a metal door frame to a floor comprises a generally planar flange securable in an upright position to an interior surface of the door frame, and a generally planar base extending generally orthogonally with respect to the flange and securable to the floor adjacent the door frame. The base comprises a central portion comprising an inner end adjacent the flange and an opposed outer end defining an outer edge. At least a first tab extends outwardly from the outer end of the central portion and beyond the outer edge.

19 Claims, 10 Drawing Sheets

(56) References Cited

U.S. PATENT DOCUMENTS 6,612,087 B2 * 9/2003 diGirolamo et al. ..... 52/712
D684,033 S * 6/2013 Preda ..... D8/354
2004/0118074 A1 * 6/2004 Quintile ..... 52/713
2005/0050816 A1 * 3/2005 Manning et al. ..... 52/213
2012/0137606 A1 * 6/2012 Mees ..... 52/204.1

* cited by examiner

DOOR FRAME ANCHOR

CROSS-REFERENCES TO RELATED APPLICATIONS

This application claims priority from Canadian Patent Application 2,767,152, filed on Feb. 6, 2012, U.S. Provisional Patent Application Ser. No. 61/611,752, filed on Mar. 16, 2012, and U.S. Provisional Patent Application Ser. No. 61/636,952, filed on Apr. 23, 2012, each of which is incorporated herein by reference in its entirety.

FIELD

The disclosure relates to a door frame anchor. Specifically, the disclosure relates to an anchor for securing a metal door frame to a floor.

BACKGROUND

U.S. Pat. No. 3,636,672 (Fink) purports to disclose a snap-in jamb anchor comprising a right angular bracket having a horizontal wedging plate arranged to establish a wedge-type friction fit with the interior surface of channel-shaped sheet metal doorjambs at opposite sides to provide a connection between the horizontal girder of a building and the jambs, thereby to support the door frame within an opening of a sheet metal wall. Jamb extensions may be secured to a vertical flange of each jamb anchor and extend upwardly above the header of the door frame to a roof girder which is located above the header so as to act in combination with the jamb anchors in stabilizing the upper portion of the metal door frame within its opening.

U.S. Pat. No. 4,539,784 (Allen) purports to disclose an adjustable device for anchoring door jambs of various sizes in a fast and efficient manner. The device includes one or more frame members which receive a pair of overlapping L-shaped planar members in sliding engagement with each other. Each frame member is generally of an L-shaped configuration having vertical and horizontal planar portions, and with a lip formed along the outer edge of the horizontal portion to provide a slot for use in retaining the overlapping members. The overlapping members each have vertical and horizontal planar portions, with the horizontal portions being of sufficient length to allow the length of the overall anchor to be varied by slidably positioning the overlapping members relative to each other. The position of each frame member relative to the overlapping members can also be adjusted to correspond with the shape and construction of a particular door jamb.

SUMMARY

The following summary is intended to introduce the reader to various aspects of the disclosure, but not to define any invention, According to one broad aspect, an anchor for securing a metal door frame to a floor comprises a generally planar flange securable in an upright position to an interior surface of the door frame, and a generally planar base extending generally orthogonally with respect to the flange and securable to the floor adjacent the door frame. The base comprises a central portion comprising an inner end adjacent the flange and an opposed outer end defining an outer edge. At least a first tab extends outwardly from the outer end of the central portion and beyond the outer edge.

In some examples, the central portion may have a first side portion and an opposed second side portion, and the first tab may extend outwardly from the first side portion.

In some examples, the anchor may comprise a second tab extending outwardly from the outer end of the central portion and beyond the outer edge. The second tab may be spaced apart from the first tab. A gap may extend between the first tab and the second tab. At least a portion of the gap may be sized to receive a portion of a stud of a wall adjacent the door frame. The central portion may have a first side portion and an opposed second side portion, and the first tab and second tab may extend outwardly from the first side portion and the second side portion, respectively.

In some examples, the base and the flange may be affixed to each other along a join line. The join line may be proximate the inner end of the central portion of the base.

In some examples, the base and the flange may be of an integral, unitary construction.

In some examples, the anchor may further comprise a mounting plate of an integral, unitary construction with the flange and extending generally orthogonally from the flange. The base may be separately formed from the flange and may be mounted to the mounting plate. The base may be positioned parallel to and beneath the mounting plate, and the base may be secured to the mounting plate with at least one mechanical fastener.

In some examples, the anchor may be fabricated from steel.

In some examples, the first tab may comprise a fastener aperture extending therethrough. Further, the central portion may comprise at least one fastener aperture extending therethrough.

According to another aspect, a door frame and anchor assembly comprises a metal door frame. The metal door frame comprises a first side jamb and a second side jamb. Each side jamb comprises a top end portion and a bottom end portion. When viewed in cross section, each side jamb is generally C-shaped and comprises an exterior surface, an opposed interior surface, a jamb interior bounded partially by the interior surface, and a jamb opening extending between the jamb interior and an exterior of the jamb. A header extends between the top end portions of the first and second side jambs. The assembly further comprises a first anchor secured to the first side jamb. The first anchor comprises a generally planar flange disposed in an upright orientation and secured to the interior surface of the first side jamb at the bottom end portion of the first side jamb. A generally planar base extends generally orthogonally with respect to the flange, and is securable to the floor adjacent the door frame. The base comprises a central portion positioned within the jamb interior and comprising an inner end adjacent the flange and an opposed outer end defining an outer edge. The base further comprises at least a first tab extending outwardly from the central portion and beyond the outer edge. The first tab protrudes from the jamb interior and through the jamb opening.

In some examples, the central portion may have a first side portion and an opposed second side portion, and the first tab may extend outwardly from the first side portion.

In some examples, the anchor may further comprise a second tab extending outwardly from the outer end of the central portion and beyond the outer edge. The second tab may be spaced apart from the first tab, and may protrude from the jamb interior and through the jamb opening. A gap may extend between the first tab and the second tab. The gap may be sized to receive a stud of a wall adjacent the door frame. The central portion may have a first side portion and an opposed second side portion, and the first tab and second tab may extend outwardly from the first side portion and the second side portion, respectively.

In some examples, the base and the flange may be affixed to each other along a join line. The join line may be proximate the inner end of the central portion of the base.

In some examples, the base and the flange may be of an integral, unitary construction.

In some examples, the anchor may further comprise a mounting plate of an integral unitary construction with the flange and extending generally orthogonally from the flange. The base may be separately formed from the flange and may be mounted to the mounting plate. The base may be positioned parallel to and beneath the mounting plate, and the base may be secured to the mounting plate with at least one mechanical fastener.

In some examples, the anchor may be fabricated from steel.

In some examples, the first tab may comprise a screw-port extending therethrough. Further, the central portion may comprise at least one fastener aperture extending therethrough.

In some examples, the anchor may be welded to the door frame.

According to another aspect, a door frame and anchor assembly comprises a metal door frame. The metal door frame comprises a first side jamb and a second side jamb. Each side jamb comprises a top end portion and a bottom end portion. When viewed in cross section, each side jamb is generally C-shaped and comprises an exterior surface, an opposed interior surface, a jamb interior bounded partially by the interior surface, and a jamb opening extending between the jamb interior and an exterior of the jamb. A header extends between the top end portion of the first side jamb and the top end portion of the second side jamb. A first anchor is secured to the first side jamb. The first anchor comprises a generally planar flange disposed in an upright orientation and secured to the interior surface of the first side jamb at the bottom end portion of the first side jamb. A generally planar base extends generally orthogonally with respect to the flange and is securable to the floor adjacent the door frame. The base comprises a central portion positioned within the jamb interior and comprising an inner end adjacent the flange and an opposed outer end proximate the jamb opening. At least a first tab extends outwardly from the outer end of the central portion. The first tab protrudes from the jamb interior and through the jamb opening. The first tab comprises at least one fastener aperture extending therethrough.

In some examples, the outer end of the central portion may define an outer edge, and the at least one tab may extend beyond the outer edge.

In some examples the first tab may comprise two fastener apertures extending therethrough and laterally spaced apart.

According to another aspect, a wall section comprises a wall frame comprising at least one generally vertical stud. The stud has a stud width extending in a lateral direction generally parallel to a thickness of the wall frame. The wall section further comprises a metal door frame positioned adjacent the stud. The metal door frame comprises a first side jamb and a second side jamb. Each side jamb comprises a top end portion and a bottom end portion. When viewed in cross section, each side jamb is generally shaped and comprises an exterior surface, an opposed interior surface, a jamb interior bounded partially by the interior surface, and a jamb opening extending between the jamb interior and an exterior of the jamb. The jamb opening of the first side jamb faces the stud. A header extends between the top end portion of the first side jamb and the top end portion of the second side jamb. The wall section further comprises a first anchor secured to the first side jamb. The first anchor comprises a generally planar flange disposed in an upright orientation and secured to the interior surface of the first side jamb at the bottom end portion of the first side jamb. A generally planar base extends generally orthogonally with respect to the flange is and securable to the floor adjacent the door frame. The base comprises a central portion positioned within the jamb interior and comprising an inner end adjacent the flange and an opposed outer end proximate the jamb opening. At least a first tab extends outwardly from the outer end of the central portion. The first tab protrudes from the jamb interior and through the jamb opening towards the stud. The first tab comprises at least one fastener aperture extending therethrough. The at least one fastener aperture is positioned outboard of the stud in the lateral direction. A fastener extends through the fastener aperture and secures the first anchor to the floor adjacent the first side jamb.

In some examples, the outer end of the central portion may define an outer edge, and the at least one tab may extend beyond the outer edge.

In some examples, the first tab may comprise two fastener apertures extending therethrough and laterally spaced apart.

According to another aspect, a wall section comprises a wall frame. The wall frame comprises at least one generally vertical stud. The stud comprises a first stud side and an opposed second stud side, and a stud width extending therebetween in a lateral direction generally parallel to a thickness of the wall frame. A first wall panel extends along the first stud side, and a second wall panel extends along the second stud side. A metal door frame is positioned adjacent the stud and comprises a first side jamb and a second side jamb. Each side jamb comprises a top end portion and a bottom end portion. When viewed in cross section, each side jamb is generally C-shaped and comprises an exterior surface, an opposed interior surface, a jamb interior bounded partially by the interior surface, and a jamb opening extending between the jamb interior and an exterior of the jamb. The jamb opening of the first side jamb faces the stud and has an opening width greater than the stud width. The first and second wall panels extend through the jamb opening and into the jamb interior. A header extends between the top end portion of the first side jamb and the top end portion of the second side jamb. A first anchor is secured to the first side jamb. The first anchor comprises a generally planar flange disposed in an upright orientation and secured to the interior surface of the first side jamb at the bottom end portion of the first side jamb. A generally planar base extends generally orthogonally with respect to the flange and is securable to the floor adjacent the door frame. The base comprises a central portion positioned within the jamb interior and comprising an inner end adjacent the flange and an opposed outer and proximate the jamb opening. At least a first tab extends outwardly from the outer end of the central portion. The first tab protrudes from the jamb interior and through the jamb opening towards the stud. The first tab comprises at least one fastener aperture extending therethrough. The at least one fastener aperture is positioned beneath and is concealed by one of the first wall panel and second wall panel. A fastener extends through the fastener aperture and secures the first anchor to the floor adjacent the first side jamb.

In some examples, the outer end of the central portion may define an outer edge, and the at least one tab may extend beyond the outer edge.

In some examples, the first tab may comprise two fastener apertures extending therethrough and laterally spaced apart.

According to another aspect, a method of securing, a metal door frame to a floor and adjacent a wall frame comprises: a)

positioning a side jamb of the door frame adjacent a generally vertical stud of the wall frame, wherein the side jamb is generally C-shaped and comprises a jamb interior and a jamb opening; b) aligning the jamb opening of the side jamb to face the stud; and c) scouting the side jamb to the floor at at least one anchor point outside of the jamb interior.

In some examples, the at least one anchor point may be laterally outboard of the stud.

In some examples, step c) may comprise securing the side jamb to the floor at two anchor points. Each anchor point may be outside of the jamb interior and laterally outboard of the stud.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION OF DRAWINGS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
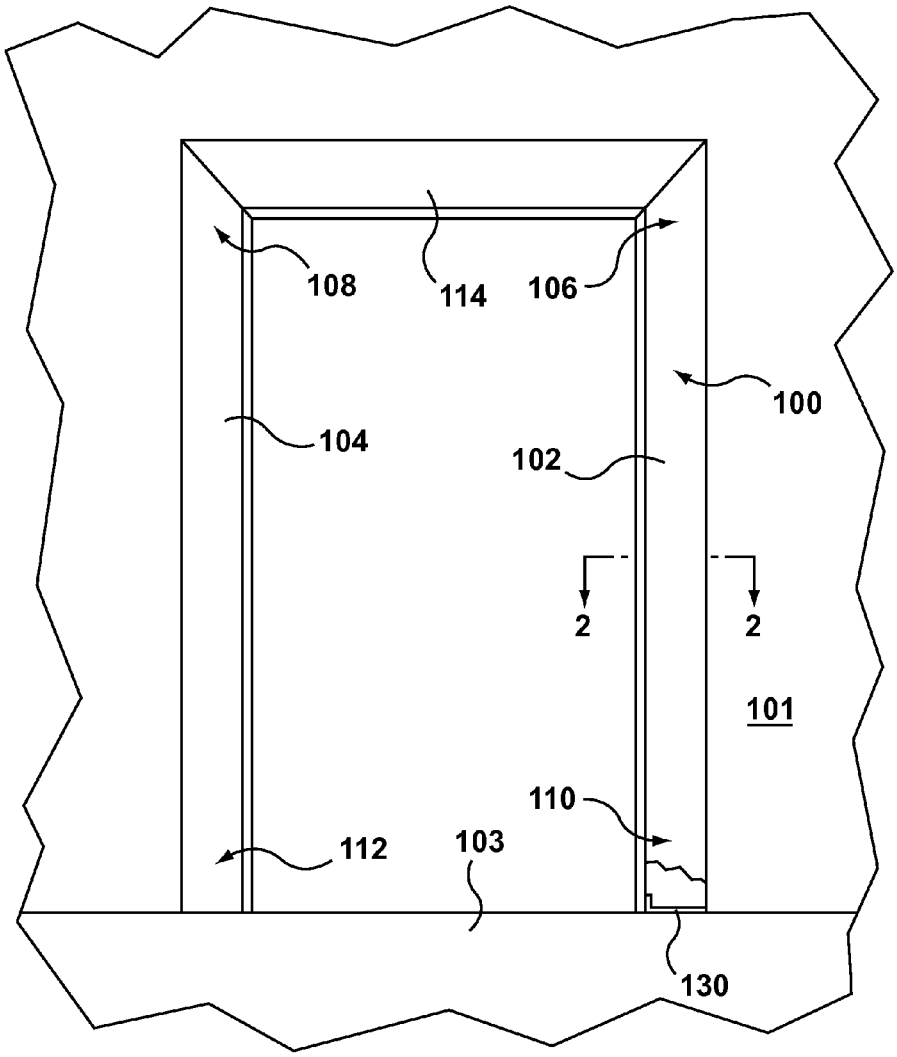
FIG. 1 is a cutaway front plan view of a door frame installed in a wall and on a floor.

Referring to FIG. 1, an exemplary metal door frame 100 is shown. The door frame 100 is installed in a wall section 101, and on a floor 103. The door frame 100 includes a first side jamb 102 and a second side jamb 104. The first side jamb 102 and the second side jamb 104 each include a top end portion 106, 108, respectively, and a bottom end portion 110, 112, respectively. A header 114 extends between the top end portion 106 of the first side jamb 102 and the top end portion 108 of the second side jamb 104.

Features of the first side jamb 102 are described below. The second side jamb 104 may be substantially identical to the first side jamb 102, and therefore for simplicity, the features of the second side jamb 104 are not described in detail.

Figure 2:
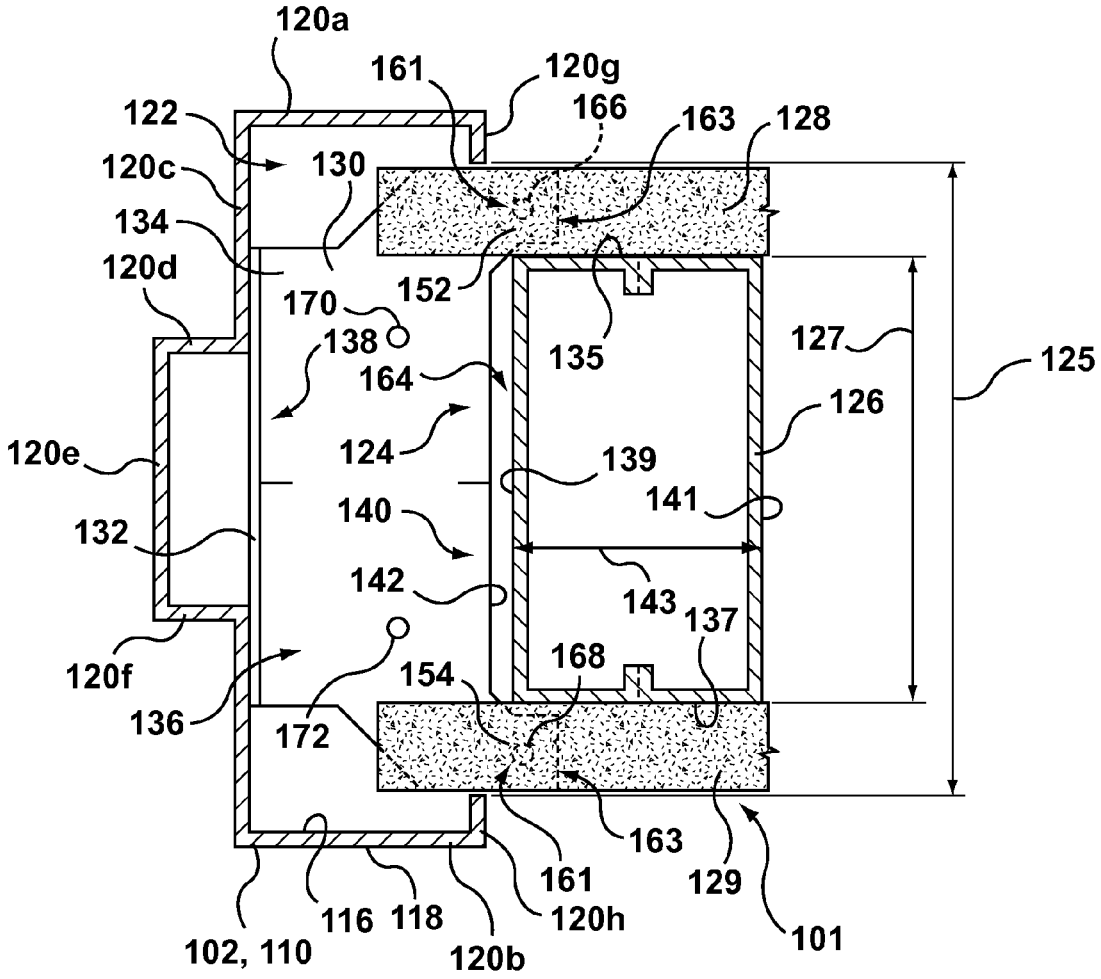
FIG. 2 is a cross section taken along line 2-2 in FIG. 1.

Referring now to FIG. 2, when viewed in cross-section, the first side jamb 102 is generally C-shaped, and includes a pair of opposed walls 120*a*, 120*b*, and a wall 120*c* extending therebetween. The wall 120*c* includes a bump out, defined by walls 120*d*, 120*e*, and 120*f*, which form an integral door stop. First 120*g* and second 120*h* return walls extend from the walls 120*a*, and 120*b*, respectively. The walls 120*a* to 120*h* define an interior surface 116 of the first side jamb 102 and an exterior surface 118 of the first side jamb 102. The first side jamb 102 includes a jamb interior 122 bounded partially by the interior surface 116, and a jamb opening 124 extending between the jamb interior 122 and an exterior of the first side jamb 102. The jamb opening 124 has an opening width 125, defined between the walls 120*a* and 120*g*.

Referring still to FIG. 2, an exemplary wall section 101 is shown. The wall section 101 includes a wall frame that includes at least one generally vertical stud 126. The stud 126 has a first stud side 135 and an opposed second stud side 137, and a stud width 127 extending therebetween in a lateral direction generally parallel to a thickness of the wall frame. Furthermore, the stud has a first stud end 139 and a second stud end 141, and a stud depth 143 extending therebetween in a longitudinal direction generally perpendicular to the lateral direction. When the door frame 100 is installed in the wall section 101, the door frame 100 is positioned adjacent the stud 126, such that the jamb opening 124 is adjacent the stud 126 and faces the stud 126. First 128 and second 129 wall panels, which in the example shown are sheets of drywall, extend along the first 135 and second 137 stud sides, respectively. The opening width 125 is greater than the stud width 127, and the wall panels extend through the jamb opening 124 and into the jamb interior 122.

Referring now to FIGS. 3A to 3D, an exemplary anchor 130 is shown. The anchor 130 usable to secure the door frame 100 to the floor 103 adjacent the door frame 100. Specifically, the anchor 130 is usable to secure the first side jamb 102 to the floor 103 adjacent the first side jamb 102. Another (or second) anchor 130 may be used to secure the second side jamb 104 to the floor 103 adjacent the second side jamb. Again, for simplicity, the use of anchor 130 to secure the only the first side jamb 102 to the floor 103 will be described.

Referring to FIGS. 2 and 3A to D, the anchor 130 includes a generally planar flange 132. The flange 132 may be secured to the interior surface 116 of the first side jamb 102 at the bottom end portion 110 of the first side jamb 102. For example, the flange 132 may be fixedly secured to the first side jamb 102, such as by welding. When the flange 132 is secured to the first side jamb 102 and the door frame 100 is installed on the floor, the flange 132 is in an upright orientation.

Referring still to FIGS. 2 and 3A to 3D, the anchor 130 further includes a generally planar base 134, which is fixed with respect to the flange 132 and extends generally orthogonally with respect to the flange 132. As will be described in further detail below, the base 134 is securable to the floor 103 adjacent the door frame 100. The base 134 includes a central portion 136 that is positioned within the jamb interior 122. The central portion 136 includes an inner end 138 adjacent the flange 132, and an opposed outer end 140 proximate the jamb opening 124. In the example shown, the outer end 140 defines an outer edge 142 of the central portion 136. The central portion further includes a first side portion 156 defining a first side edge 158 of the central portion, and a second side portion 160 defining a second side edge 162 of the central portion (shown in FIG. 3C).

Figure 3B:
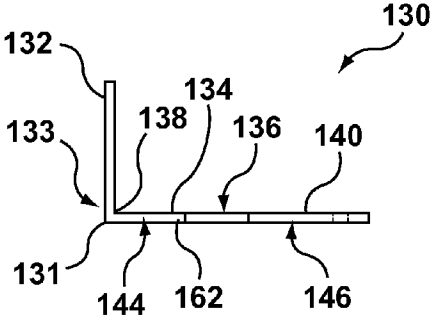
FIG. 3B is a side plan view of the anchor of FIG. 3A.
Figure 3A:
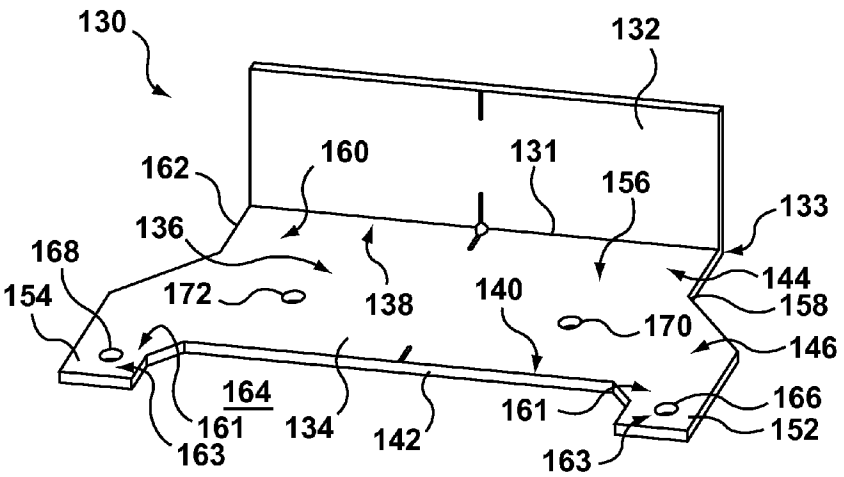
FIG. 3A is a perspective illustration of an exemplary anchor.
Figure 3C:
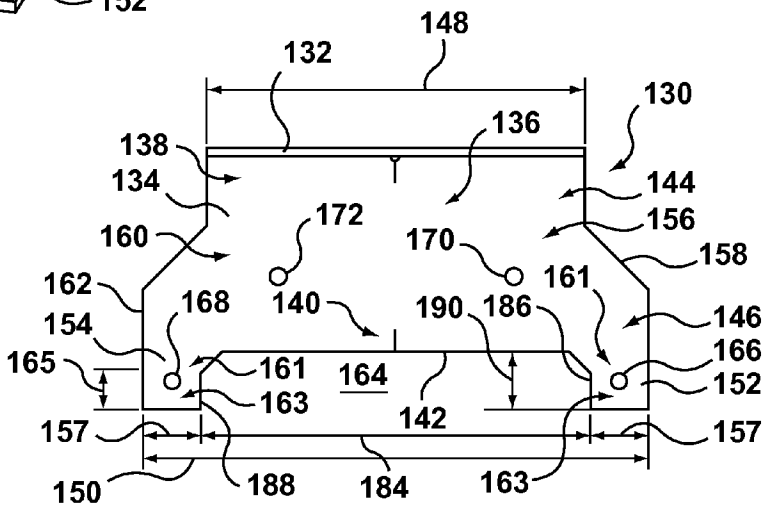
FIG. 3C is a top plan view of the anchor of FIG. 3A.
Figure 3D:
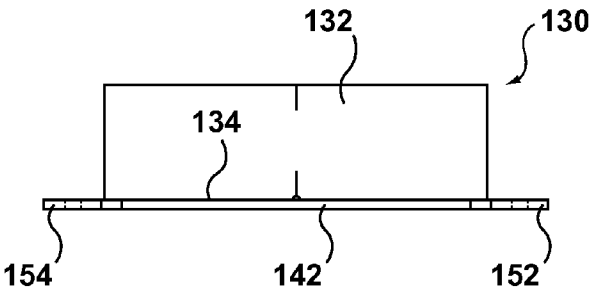
FIG. 3D is a front plan view of the anchor of FIG. 3A.

Referring to FIGS. 3A and 3C, in the example shown, the central portion includes an inner portion 144 adjacent the inner end 138, and an outer portion 146 adjacent the outer end 140. The width 148 of the inner portion 144 is less than the width 150 of the outer portion 146 (shown in FIG. 3C). Specifically, the width 148 of the inner portion 144 is the same as the width of the flange 132, and the width of the outer portion 146 is larger than the width of the flange 132, and slightly less than the width 125 of the jamb opening 124. In alternate examples (not shown), the central portion may have a constant width, for example the width of the entirety of the central portion may be slightly less than the width of the jamb opening. In further alternate examples (not shown), the central portion may be of another suitable shape or size. For example the central portion may be shaped and sized depending on the particular configuration of the door frame.

Referring still to FIGS. 2 and 3A to 3D, in the example shown, the base 134 includes a first tab 152 and a second tab 154. The first tab 152 and the second tab 154 each extend outwardly from the outer end 140 of the central portion 136, and protrude from the jamb interior 122 and through the jamb opening 124.

In the example shown, the first tab 152 and second tab 154 each extend beyond the outer edge 142 of the central portion 136. Further, in the example shown, the first tab 152 and the second tab 154 are spaced apart, and a gap 164 extends between the first tab 152 and the second tab 154. The gap 164 has a width 184 extending between inner edges 186, 188 of the first tab 162 and second tab 154, respectively, and depth 190 extending outwardly from the outer edge 142 of the central portion 136 (shown in FIG. 30). As will be described in further detail below, at least a portion of the gap 164 is generally sized to receive the stud 126 therein.

Referring to FIGS. 3A to 3D, and particularly to FIG. 3C, in the example shown, the first tab 152 extends outwardly from the first side portion 156 and is adjacent the first side edge 158, and the second tab 154 extend outwardly from the second side portion 160 and is positioned adjacent the second side edge 162. In alternate examples, the first tab 152 and second tab 154 may be spaced inwardly from the first side edge 168 and second side edge 162, respectively.

Referring to FIGS. 2, and 3A to 3D, the first tab 152 and second tab 154 may be of various shapes and sizes. In the example shown, each tab has a proximal portion 161 adjacent the outer end 140 of the central portion 136, and an opposed distal portion 163. Each distal portion 163 is generally rectangular, and has a distal portion width 157 and a distal portion length 165 (shown in FIG. 3C). The distal portion width 157 may be selected such that when the anchor 130 is secured to the door frame 100 and the door frame 100 is installed in the wall section 101, the distal portion 163 fits closely between the first side jamb 102 and the stud 126. The distal portion width 157 may vary depending, for example, on the size of the door frame 100. In some particular examples, the distal portion width 157 may be about 15 mm. The distal portion length 165 may be selected such that the distal portion 163 is generally accessible to a user from the exterior of the door frame 100. In some examples the distal portion length 165 is about 9 mm.

In alternate examples, the tabs 152, 154 may be of another shape. For example, the tabs may be rectangular. In such examples, the tabs may not have a distal portion and a proximal portion. Rather, the entirety of the tab may have a width that is selected such that the entirety of the tab fits closely between the first side jamb 102 and the stud 126.

Referring still to FIGS. 2 and 3A to 3D, in the example shown, the first tab 152 includes a fastener aperture 166 extending therethrough, and the second tab 154 includes a fastener aperture 168 extending therethrough. The fastener apertures 166, 168 extend through the distal portions 163 of the tabs 152, 154. In the example shown, the fastener apertures 166, 168 are positioned such that, in use, when the door frame 100 is positioned adjacent the stud 126, the apertures 166, 168 are outboard of the stud 126 in the lateral direction (i.e. the direction of the stud width 127). That is, the position of the apertures 166, 168 in the lateral direction is not between the stud sides 135, 137. Furthermore, in the example shown, the fastener apertures 166, 168 are spaced from the side jamb 102 in the longitudinal direction. Specifically, in the example shown, the fastener apertures 166, 168 are positioned such that they are inboard of the stud 126 in the longitudinal direction (i.e. the direction perpendicular to the stud width 127). That is, the position of the apertures 166, 168 in the longitudinal direction is between the stud ends 139, 141.

Referring still to FIGS. 2 and 3A to 3D, in the example shown, the central portion 136 also includes at least one fastener aperture extending therethrough. In the example shown, the central portion 136 includes a first fastener aperture 170 and a second fastener aperture 172 extending therethrough.

The fastener apertures 166, 168, 170, and 172 provide anchor points for securing the door frame 100 to the floor. Specifically, the fastener apertures 166, 168, 170, and 172 may be sized and shaped to receive a fastener such as a screw therethrough, for screwing the base 134 to the floor 103, as will be described in further detail below.

In use, the door frame 100 may be supplied with an anchor 130 already secured to each of the first side jamb 102 and the second side jamb 104. For example, as described above, the flange 132 of the anchor 130 may be welded in an upright position to the interior surface 116 of the first side jamb 102 at the bottom end portion 110 of the first side jamb 102.

In some instances, the door frame may be installed to the floor 103 before the well section 101 is built. In such instances, the door frame 100 may be positioned in a desired location on the floor 103, so that the base 134 of the anchor is facing the floor 103. The base 134 may then be secured to the floor 103, for example by securing a suitable fastener through any of the fastener apertures 166, 168, 170, 172 and into the floor 103. In some examples, a fastener may be secured through each of the fastener apertures 166, 168, 170, 172. In other examples, fasteners may be secured through only some of the fastener apertures. For example, fasteners may be secured through only the fastener apertures 170, 172 of the central portion 136, or through only the fastener apertures 166, 168 of the tabs 152, 154. In some instances, as will be described in further detail below, it may be desirable to secure fasteners through only the fastener apertures 170, 172 of the central portion 136.

Referring to FIG. 2, after the door frame 100 is secured to the floor by the anchor 130, the wall section 101 may be built around the door frame 100. When building the wall section 101, the stud 126 may be positioned such that at least a portion of the stud 126 is between the first tab 152 and the second tab 154, and more specifically between the distal portions 163 of the first tab 152 and second tab 154, in the gap 164. When the stud 126 is installed, the first tab 152 and the second tab 154, and particularly the distal portions 163 of the first tab 152 and second tab 154, remain generally accessible to an installer, as they protrude from the jamb opening 124 and are positioned on either side of the stud 126. Furthermore, in the example shown, as the apertures 166, 168 are provided in the tabs 152, 154, respectively, and are positioned laterally outboard of the stud 126 and longitudinally spaced from the side jamb 102, the apertures 166, 168 remain generally accessible to an installer.

The first sheet of drywall 128 may then be inserted through the jamb opening 124 and into the jamb interior 122, so that the first tab 152 and fastener aperture 166 are beneath the first sheet of drywall 128, and so that the first tab 152 and fastener aperture 166 are concealed by the first sheet of drywall 128. The second sheet of drywall 129 may be inserted through the jamb opening 124 and into the jamb interior 122, so that the second tab 154 and fastener aperture 168 are beneath the second sheet of drywall 129, and so that the second tab 154 and fastener aperture 168 are concealed by the second sheet of drywall 129.

As mentioned above, it may be desirable to secure fasteners through only the fastener apertures 170, 172 of the central portion 136. In some instances, prior to or during construction of the wall section 101 (for example after the stud 126 is installed and before the drywall 128, 129 is installed), the door frame 100 may be bumped, and one or more of the fasteners may break. In such instances, if fasteners were originally secured through only the fastener apertures 170, 172 of the central portion 136, then the broken fastener may simply be left in place, and an additional fastener may subsequently be secured through one or both of the fastener apertures 166, 168 of the tabs 152, 154. As the tabs 152, 154 remain accessible even after the stud 126 is installed, the additional fasteners may be secured through the fastener apertures 166, 168 of the tabs 152, 154 with relative ease, even if the break occurs after the stud 126 is installed. That is, the apertures 166 and 168 provide anchor points that are outside of the jamb interior 122, laterally outboard of the stud 126, and longitudinally spaced from the side jamb 102, and are therefore accessible even after the stud 126 is installed.

In other instances, the door frame 100 may be installed to the floor 103 after a portion of the wall section 101 is built, for example after the stud 126 is installed. In such instances, the first side jamb 102 may be positioned adjacent the stud 126, the jamb opening 124 may be aligned to face the stud 126, and the anchor 130 may be positioned such that at least a portion of the stud 126 is between the first tab 152 and the second tab 154, and more specifically between the distal portions 163 of the first tab 152 and second tab 154, in the gap 164.

The base 134 may then be secured to the floor, for example by securing a suitable fastener through any of the fastener apertures 166, 168, 170, 172 and into the floor 103. However, for ease of installation, it may be desirable to secure the base 134 to the floor at anchor points that are outside of the jamb interior 122, and laterally outboard of the stud 126, as such anchor points are generally accessible even after the stud 126 is installed. Particularly, in the example shown, a fastener may be secured through only the fastener apertures 166, 168 of the tabs 152, 154, which are generally accessible even after the stud 126 is installed.

Figure 7:
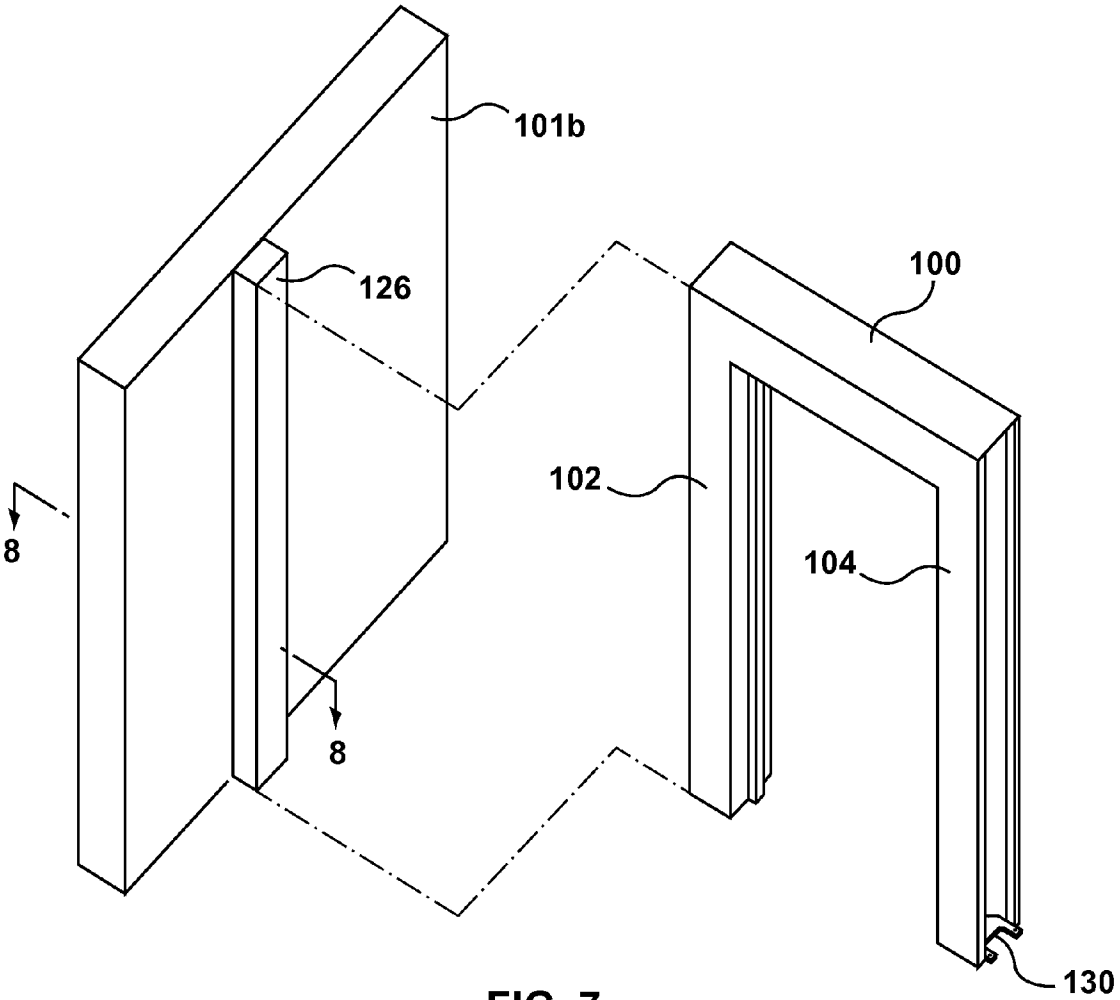
FIG. 7 is a perspective illustration of a door frame that is to be installed adjacent an orthogonal wall.
Figure 8:
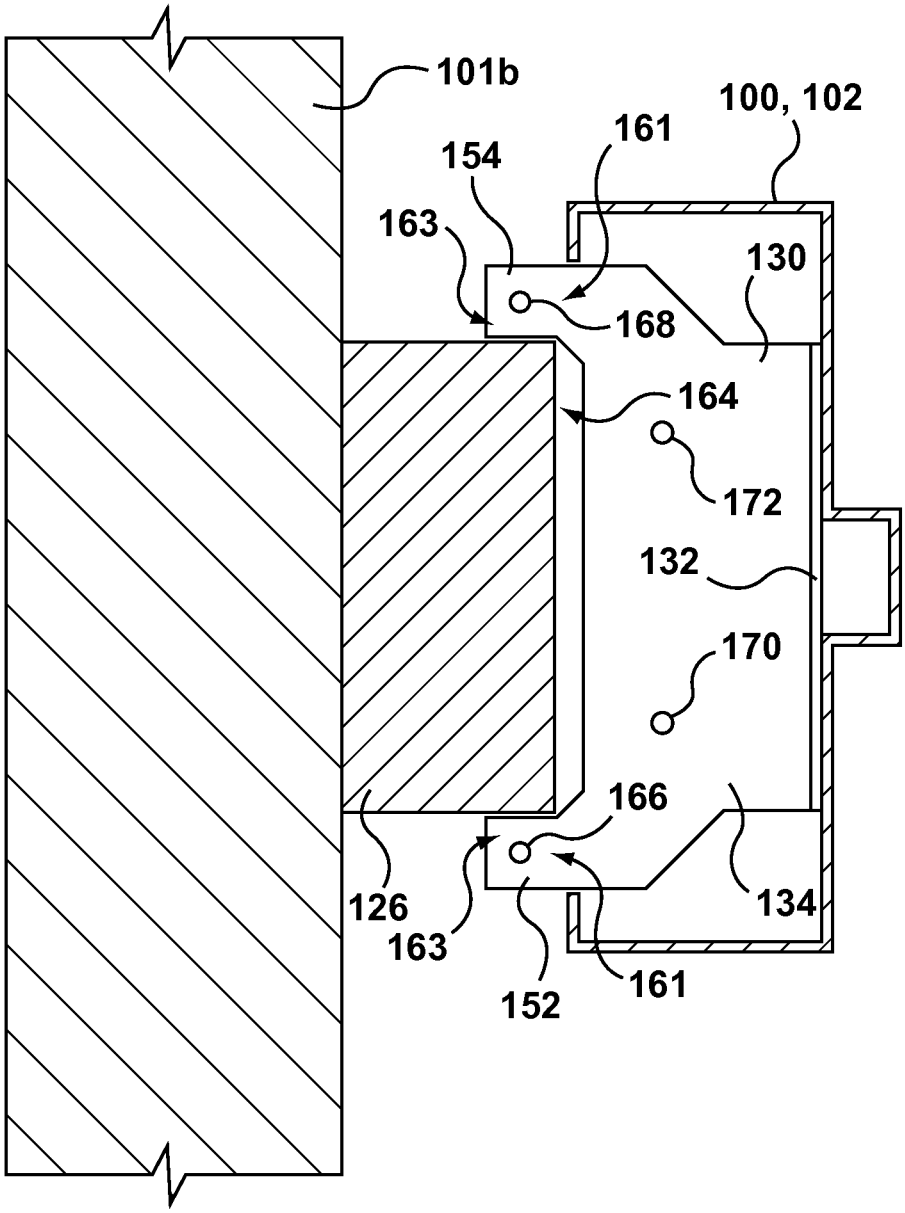
FIG. 8 is a cross section taken along line 8-8 in FIG. 7, after the door frame has been positioned adjacent the orthogonal wall.

In further instances, the door frame 100 may be installed in a position that is adjacent and orthogonal to another wall section 101*b*, as shown in FIGS. 7 and 8. Particularly, the door frame 100 may be installed after the wall section 101*b* is built, and after the stud 126 is installed. In such instances, the door frame 100 may be positioned orthogonally to the wall section 101*b*, and adjacent the stud 126, such that at least a portion of the stud 126 is between the first tab 152 and, the second tab 154 (shown in FIG. 8), and more specifically between the distal portions 163 of the first tab 152 and second tab 154, in the gap 164. The base 134 may then be secured to the floor. Due to the positioning of the wall section 101*b*, it may be generally difficult to access the apertures 170, 172 of the central portion 136. However, as the fastener apertures 166, 168 of the tabs 152, 154 are outside of the jamb interior 122 and laterally outboard of the stud 126, the apertures 166, 168 remain accessible, even when the wall section 101*b* is present. Accordingly, a suitable fastener may be secured through the fastener apertures 166, 168 of the tabs 152, 154.

Figure 4:
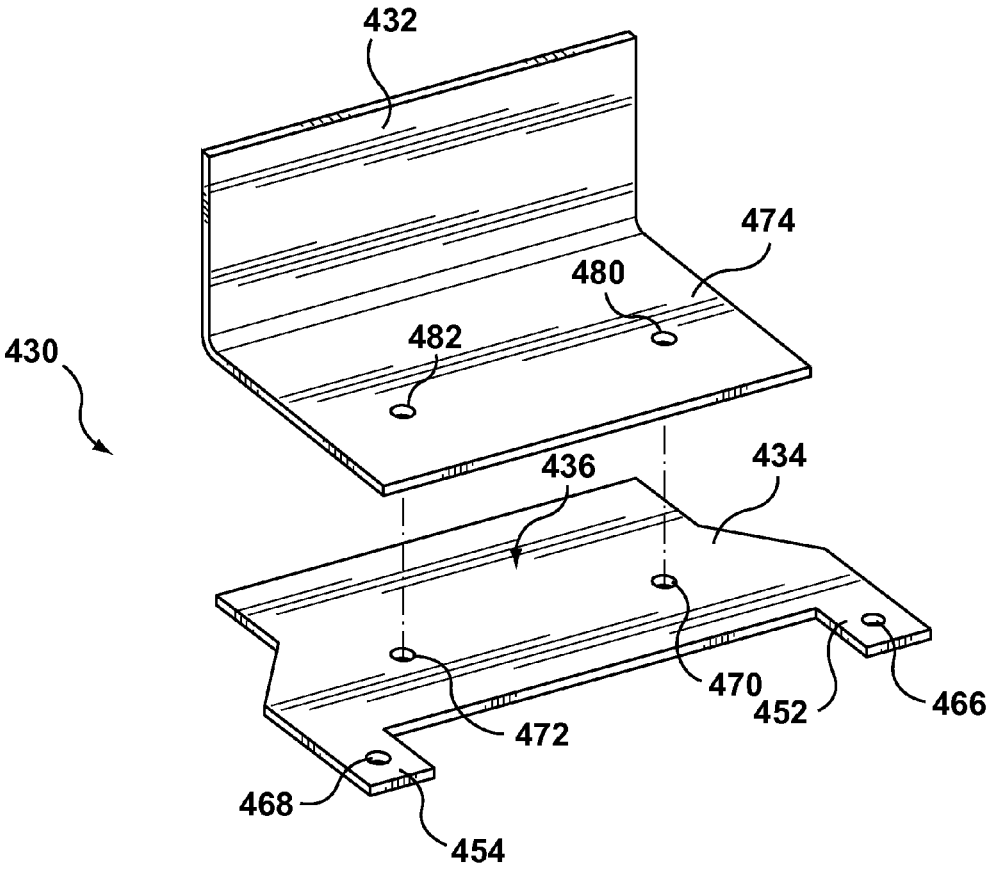
FIG. 4 is a exploded perspective illustration of another exemplary anchor
Figure 5A:
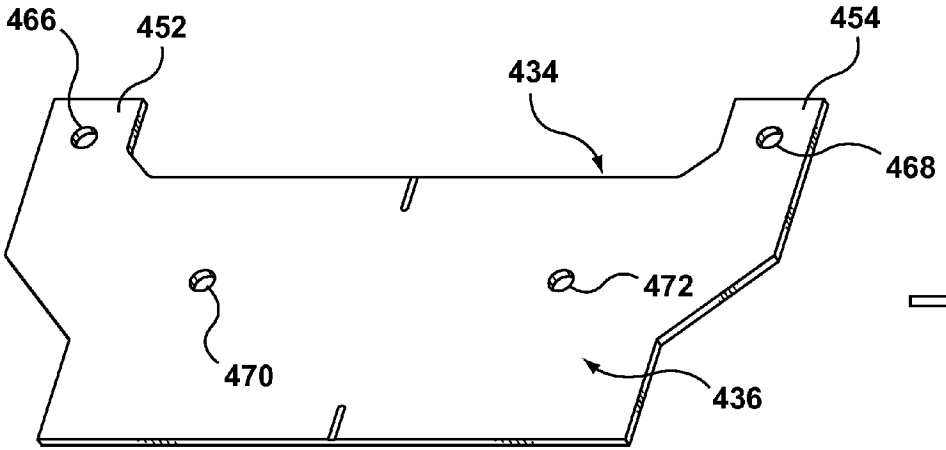
FIG. 5A is a perspective illustration of the base of the anchor of FIG. 4.
Figure 5B:
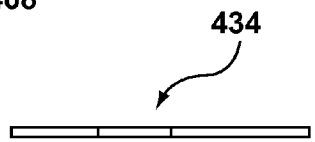
FIG. 5B is a side plan view of the base of the anchor of FIG. 4.
Figure 5C:
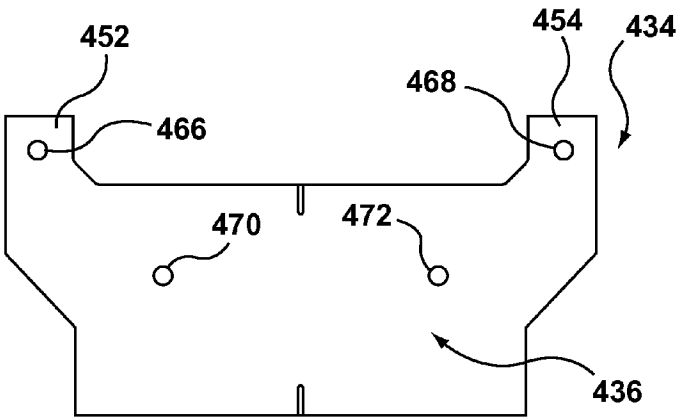
FIG. 5C is a top plan view of the base of the anchor of FIG. 4.
Figure 5D:
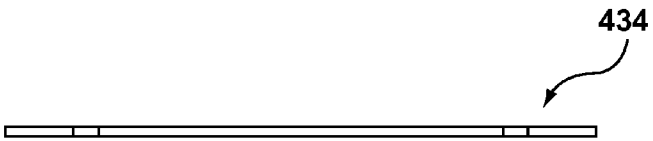
FIG. 5D is a front plan view of the base of the anchor of FIG. 4.

In the anchor 130 of FIGS. 2 and 3, the base 134 and the flange 132 are of an integral unitary construction, and the base 134 and the flange 132 are affixed to each other along a join line 131 proximate the inner end 138 and in a bend region 133 of the anchor 130. In alternate examples, the base and the flange may be separately formed. For example, referring to FIGS. 4 and 5, wherein like reference numerals are used to refer to like features as in FIGS. 1 to 3, incremented by 300, an alternate anchor 430 is shown wherein the base 434 is separately formed from the flange 432.

In the example shown, the anchor 430 includes a mounting plate 474 that is of an integral, unitary construction with the flange 432, and that extends generally orthogonally from the flange 432. The mounting plate 474 includes two fastener apertures 480, 482 extending therethrough. The base 434 may be mounted to the mounting plate 474 to secure the base 434 to the flange 432. For example, the base 434 may be positioned parallel to and beneath the mounting plate 474, so that the fastener apertures 470, 472 of the central portion 436 of the base 434 align with the fastener apertures 480, 482 of the mounting plate 474. One or more mechanical fasteners may then be used to secure the base 434 to the mounting plate 474. In, some examples, the fasteners may include self-drilling screws that may be passed through the mounting plate 474 and the base 434. In such examples, the fastener apertures 470, 472 of the central portion 436 of the base 434 and the fastener apertures 480, 482 of the mounting plate 474 may remain available for use in securing the anchor 430 to the floor 103. In alternate examples, a fastener may be passed through the fastener apertures 470, 472 of the central portion 436 of the base 434 and the fastener apertures 480, 482 of the mounting plate 474 to secure the mounting plate 474 to the base 434. In such examples, the fastener apertures 466, 468 of the first tab 452 and the second tab 464 may be used to secure the anchor 430 to the floor.

Figure 6:
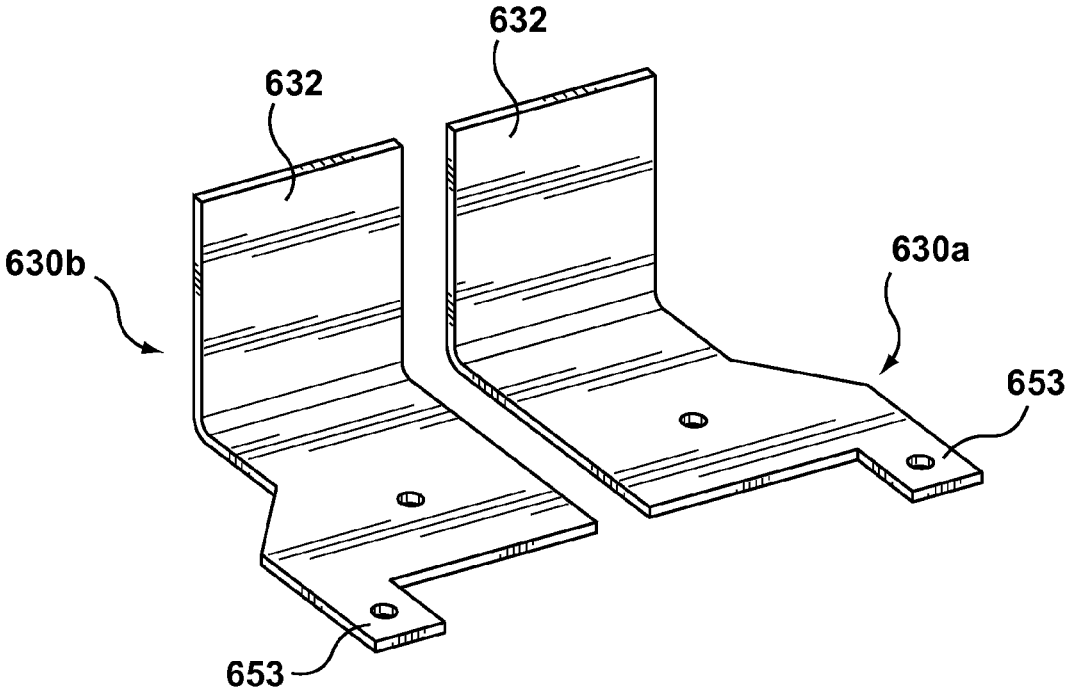
FIG. 6 is a perspective illustration of an exemplary pair of anchors.

Referring now to FIG. 6, wherein like reference numerals are used to refer to like features as in FIGS. 1 to 3, incremented by 500, a further example is shown in which a pair of separately formed anchors 630*a*, 630*b* cooperate to secure the door frame to the floor. In this example, each anchor 630*a*, 630*b* generally corresponds to a half of the anchor 130 of FIG. 3, and when the anchors 630*a*, 630*b* are combined, they act in a similar fashion to the anchor 130 of FIG. 3. Each anchor 630*a*, 630*b* may be separately secured to the door frame, for example by welding the flange 632 of each anchor 630*a*, 630*b* to the door frame. Further, when secured to the door frame, the anchors 630*a* 630*b* may optionally be spaced apart. The distance by which they are spaced apart may be selected based on the size of the door frame. This may be advantageous because the anchors 630*a*, 630*b* may be manufactured in a single size, but may still be used with door frames of various sizes. In this example, each anchor 630*a*, 630*b* includes only a single tab 663.

Figure 9:
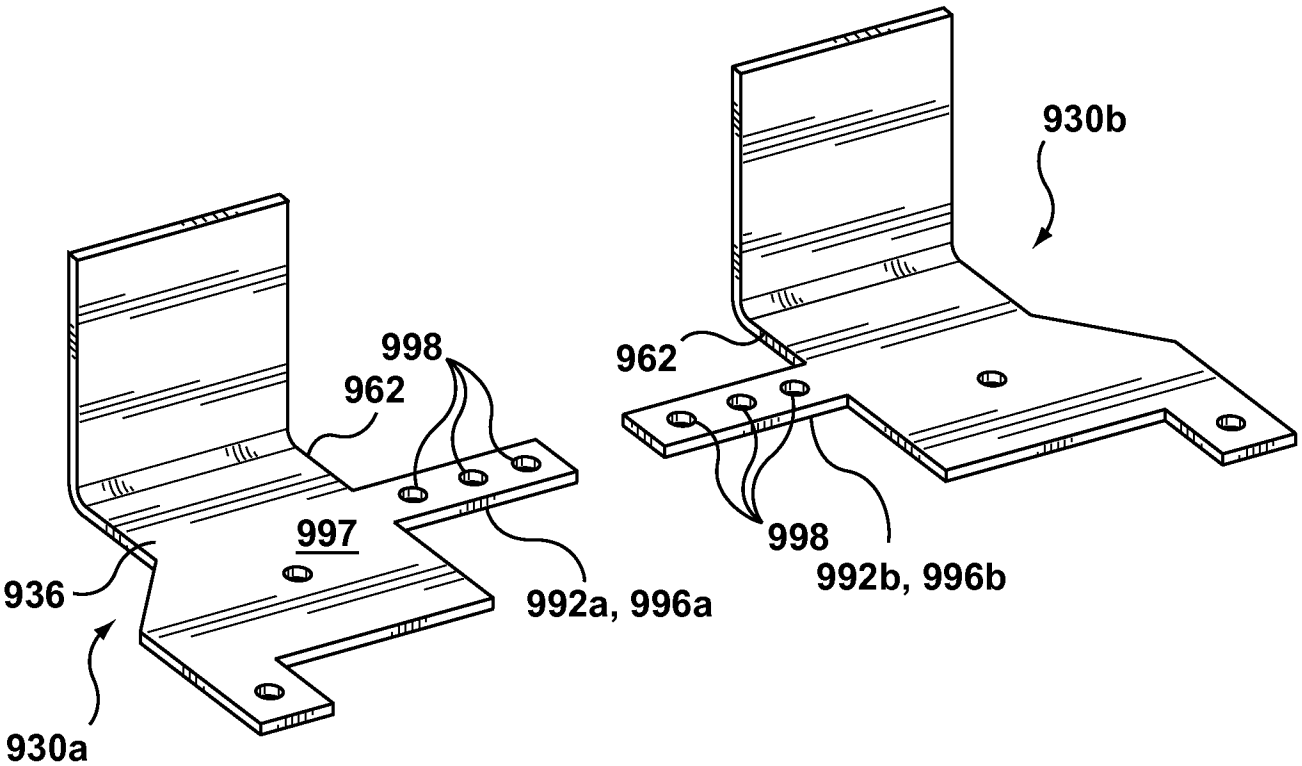
FIG. 9 is a perspective illustration of another exemplary pair of anchors.

Referring now to FIG. 9, wherein like reference numerals are used to refer to like features as in FIGS. 1 to 3, incremented by 800, a further exemplary pair of separately formed anchors 930*a*, 930*b* are shown. The anchors 930*a*, 930*b* are similar to the anchors 630*a*, 630*b* of FIG. 6, however each anchor 930*a*, 930*b* further includes an attachment member 992*a*, 992*b*, respectively. The attachment members 992*a*, 992*b* may be secured together to secure the anchors 930*a*, 930*b* together. In the example shown, the attachment member 992*a* includes an upper leg 996*a* extending outwardly from the inner side edge 962 of the central portion 936 the anchor 992*a*. The upper leg 996*a* is positioned adjacent a top surface 997 of the central portion 936, and is spaced from the bottom surface (not shown) of the central portion. The attachment member 992*b* includes a lower leg 996*b* extending outwardly from the inner side edge 962 of the central portion 936 the anchor 992*b*. The lower leg 996*b* is positioned adjacent a bottom surface (not shown) of the central portion, and is spaced from the top surface 997. Each attachment member 992*a*, 992*b* includes a plurality of fastener apertures 998 extending therethrough, and spaced apart along the length of the attachment members 992*a*, 992*b*. In use, the upper leg 996*a* may be positioned on top of the lower leg 996*b*, so that at least one of the fastener apertures 998 of the upper leg 996*a* aligns with at least one of the fastener apertures 998 of the lower leg 996*b*. A fastener, such as a screw, may then be passed through the aligned fastener apertures 998, to secure the anchors 930*a*, 930*b* together. Furthermore, similarly to the anchors 630*a* and 630*b*, the anchors 930*a* and 930*b* may be spaced apart, and the distance by which they are spaced apart may be selected based on the size of the door frame. In order to accommodate different spacings, the alignment of the fastener apertures 998 may be adjusted. For example, if the anchors 930*a*, 930*b* are to be positioned relatively far apart from each other, the outermost aperture 998 of the upper leg 996*a* may be aligned with the outermost aperture 998 of the lower leg 996*b*. If the anchors 930*a*, 930*b* are to be positioned closer to each other, each of the apertures 998 of the upper leg 996*a* may be aligned with one of the apertures 998 of the lower leg 996*b*, so that the upper leg 996*a* overlies the lower leg.

Figure 10:
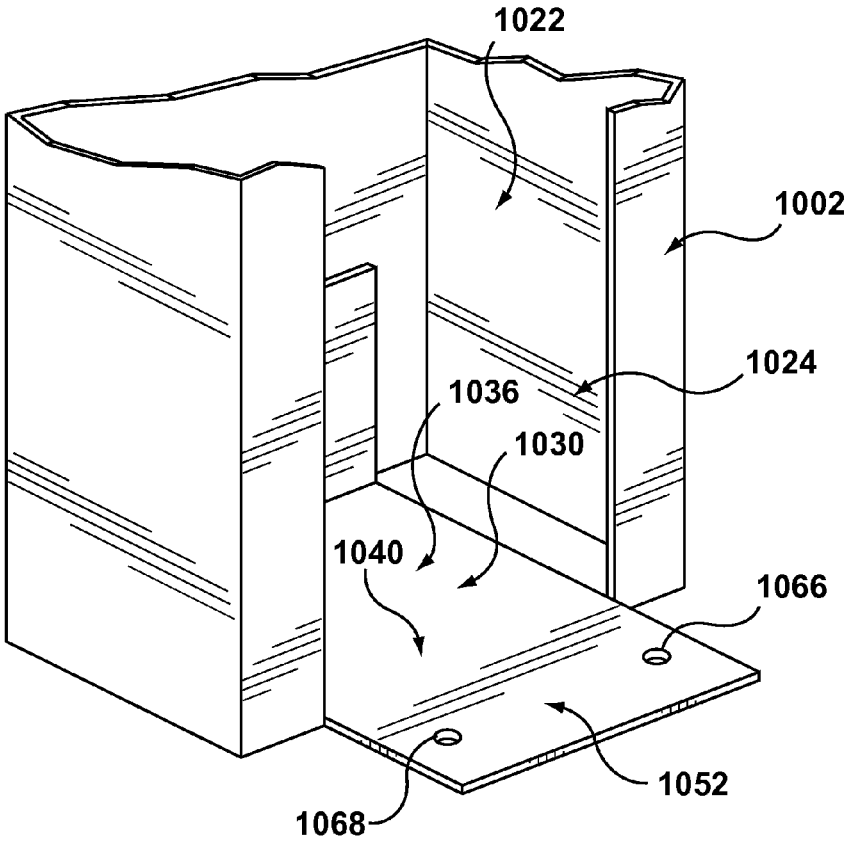
FIG. 10 is a perspective illustration of a portion of a door frame having an alternate exemplary anchor secured thereto.

Referring now to FIG. 10, wherein like reference numerals are used to refer to like features as in FIGS. 1 to 3, incremented by 900, an alternate exemplary anchor 1030 is shown. FIG. 10 illustrates a first side jamb 1002 having a jamb opening 1024. Similarly to the anchor 130, the anchor 1030 includes a central portion 1036 that is positioned within the jamb interior 1022. However, the anchor 1030 includes a single tab 1052, which extends outwardly from the outer end 1040 of the central portion 1036, and across the entire width of the central portion 1036. The tab 1052 includes two fastener apertures 1066, 1068, which are laterally spaced apart, and in use, are positioned laterally outboard of a stud (not shown).

In any of the above examples, the anchor may be made from a metal such as steel. In some particular examples, the anchor may be made from 14 gauge steel, or 16 gauge steel.

While the above description provides examples of one or more processes or apparatuses, it will be appreciated that other processes or apparatuses may be within the scope of the accompanying claims.

The invention claimed is:

1. A door frame and anchor assembly comprising:

a) a metal door frame comprising (i) a first side jamb and a second side jamb, each side jamb comprising a top end portion and a bottom end portion, and when viewed in cross section, each side jamb being generally C-shaped and comprising an exterior surface, an opposed interior surface, a jamb interior bounded partially by the interior surface, and a jamb opening extending between the jamb interior and an exterior of the jamb, and (ii) a header extending between the top end portion of the first side jamb and the top end portion of the second side jamb; and b) a first anchor secured to the first side jamb, the first anchor comprising a generally planar flange disposed in an upright orientation and secured to the interior surface of the first side jamb at the bottom end portion of the first side jamb, and a generally planar base extending in a longitudinal direction that is generally orthogonal with respect to the flange and is generally parallel with and securable to the floor adjacent the door frame when the flange is in the upright orientation, the base comprising (i) a central portion positioned within the jamb interior and comprising an inner end adjacent the flange and an opposed outer end spaced apart from the inner end in the longitudinal direction and defining an outer edge, (ii) a first tab extending in the longitudinal direction outwardly from the central portion and beyond the outer edge, the first tab protruding from the jamb interior and through the jamb opening, and (iii) a second tab extending in the longitudinal direction outwardly from the outer end of the central portion and beyond the outer edge, the second tab spaced apart from the first tab, the second tab protruding from the jamb interior and through the jamb opening.

2. The assembly of claim 1, wherein a gap extends between the first tab and the second tab.

3. The assembly of claim 2, wherein at least a portion of the gap is sized to receive at least a portion of a stud of a wall adjacent the door frame.

4. The assembly of claim 1, wherein the central portion has a first side portion and an opposed second side portion, and the first tab and second tab extend outwardly from the first side portion and the second side portion, respectively.

5. The assembly of claim 1, wherein the central portion has a first side portion and an opposed second side portion, and the first tab extends outwardly from the first side portion.

6. The assembly of claim 1, wherein the base and the flange are affixed to each other along a join line, the join line proximate the inner end of the central portion of the base.

7. The assembly of claim 6, wherein the base and the flange are of an integral, unitary construction.

8. The assembly of claim 1, wherein:

a) the anchor further comprises a mounting plate of an integral unitary construction with the flange and extending generally orthogonally from the flange; and b) the base is separately formed from the flange and is mounted to the mounting plate.

9. The assembly of claim 8, wherein the base is positioned parallel to and beneath the mounting plate, and the base is secured to the mounting plate with at least one mechanical fastener.

10. The assembly of claim 1, wherein the anchor is fabricated from steel.

11. The assembly of claim 1, wherein the first tab comprises a screw-port extending therethrough.

12. The assembly of claim 1, wherein the central portion comprises at least one fastener aperture extending therethrough.

13. The assembly of claim 1, wherein the anchor is welded to the door frame.

14. A wall section comprising:

a) a wall frame comprising at least one generally vertical stud, the stud having a stud width extending in a lateral direction generally parallel to a thickness of the wall frame;

b) a metal door frame positioned adjacent the stud and comprising (i) a first side jamb and a second side jamb, each side jamb comprising a top end portion and a bottom end portion, and when viewed in cross section, each side jamb being generally C-shaped and comprising an exterior surface, an opposed interior surface, a jamb interior bounded partially by the interior surface, and a jamb opening extending between the jamb interior and an exterior of the jamb, the jamb opening of the first side jamb facing the stud, and (ii) a header extending between the top end portion of the first side jamb and the top end portion of the second side jamb; and c) a first anchor secured to the first side jamb, the first anchor comprising a generally planar flange disposed in an upright orientation and secured to the interior surface of the first side jamb at the bottom end portion of the first side jamb, and a generally planar base extending generally orthogonally with respect to the flange and being generally horizontal and securable to the floor adjacent the door frame when the flange is in the upright orientation, the base comprising (i) a central portion positioned within the jamb interior and comprising an inner end adjacent the flange and an opposed outer end proximate the jamb opening, and (ii) at least a first tab extending horizontally outwardly from the outer end of the central portion, the first tab protruding from the jamb interior and through the jamb opening towards the stud, the first tab comprising at least one fastener aperture extending vertically therethrough, the at least one fastener aperture positioned outboard of the stud in the lateral direction; and d) a fastener extending generally vertically through the fastener aperture and securing the first anchor to the floor adjacent the first side jamb.

15. The assembly of claim 14, wherein the outer end of the central portion defines an outer edge, and the at least one tab extends beyond the outer edge.

16. The assembly of claim 14, wherein the first tab comprises two fastener apertures extending therethrough, and each fastener aperture is positioned outboard of the stud in the lateral direction.

17. A wall section comprising:

a) a wall frame comprising (i) at least one generally vertical stud, the stud comprising a first stud side and an opposed second stud side, and a stud width extending therebetween in a lateral direction generally parallel to a thickness of the wall frame; and (ii) a first wall panel extending along the first stud side, and a second wall panel extending along the second stud side;

b) a metal door frame positioned adjacent the stud and comprising (i) a first side jamb and a second side jamb, each side jamb comprising a top end portion and a bottom end portion, and when viewed in cross section, each side jamb being generally C-shaped and comprising an exterior surface, an opposed interior surface, a jamb interior bounded partially by the interior surface, and a jamb opening extending between the jamb interior and an exterior of the jamb, the jamb opening of the first side jamb facing the stud and having an opening width greater than the stud width, the first and second wall panels extending through the jamb opening and into the jamb interior, and (ii) a header extending between the top end portion of the first side jamb and the top end portion of the second side jamb; and c) a first anchor secured to the first side jamb, the first anchor comprising a generally planar flange disposed in an upright orientation and secured to the interior surface of the first side jamb at the bottom end portion of the first side jamb, and a generally planar base extending generally orthogonally with respect to the flange and generally horizontally when the flange is in the upright orientation and securable to the floor adjacent the door frame, the base comprising (i) a central portion positioned within the jamb interior and comprising an inner end adjacent the flange and an opposed outer end spaced apart from the inner end in a longitudinal direction and proximate the jamb opening, and (ii) at least a first tab extending generally in the longitudinal direction and outwardly from the outer end of the central portion, the first tab protruding from the jamb interior and through the jamb opening towards the stud, the first tab comprising at least one fastener aperture extending therethrough, the at least one fastener aperture positioned beneath and concealed by one of the first wall panel and second wall panel; and d) a fastener extending through the fastener aperture and securing the first anchor to the floor adjacent the first side jamb.

18. The assembly of claim 17, wherein the outer end of the central portion defines an outer edge, and the at least one tab extends beyond the outer edge.

19. The assembly of claim 17, wherein the first tab comprises two fastener apertures extending therethrough, and each fastener aperture is positioned beneath and concealed by one of the first wall panel and second wall panel, respectively.

* * * * *